US005739445A

United States Patent [19]

Terry et al.

[11] Patent Number: 5,739,445

[45] Date of Patent: Apr. 14, 1998

[54] GUITAR SLIDE BAR HOLDER

[76] Inventors: Mark Terry, 750 Woodlawn, Jackson, Mich. 49203; Donald D. Terry, 423 W. Ganson, Jackson, Mich. 49201

[21] Appl. No.: 781,391

[22] Filed: Jan. 10, 1997

[51] Int. Cl.[6] ..... G10D 3/00

[52] U.S. Cl. ..... 84/329; 84/327; 224/183; 224/607; 224/257; 224/910

[58] Field of Search ..... 84/329, 453, 319, 84/327; 224/910, 183, 607, 257

[56] References Cited

U.S. PATENT DOCUMENTS

D. 309,674 8/1990 Gervase ..... 84/329

3,181,410 5/1965 Phillips ..... 84/329

4,467,693 8/1984 Nasfell, Jr. ..... 84/329

4,790,232 12/1988 Rosen ..... 84/329

*Primary Examiner*—Cassandra C. Spyrou

*Attorney, Agent, or Firm*—Young & Basile, P.C.

[57] ABSTRACT

A holder for a guitar slide bar wherein the slide bar may be conveniently stored by the musician on the guitar strap, the holder eliminating the necessity to search for the slide bar when needed. The slide bar holder consists of a U-shaped body which is clipped upon the guitar strap and a portion of the body supports the slide bar retaining apparatus, which may either be in the form of resilient clips, or magnets, if a ferrous slide is employed.

9 Claims, 1 Drawing Sheet

GUITAR SLIDE BAR HOLDER

BACKGROUND OF THE INVENTION

1. Field of the Invention

The invention pertains to holders for guitar slide bars for holding the slide bar during playing of the guitar.

2. Description of the Related Art

In the process of playing a guitar, the musician will often use a slide bar, often referred to as a slide, which simultaneously engages all of the strings and may be moved up and down the guitar neck to produce a particular varying frequency sound from the strings. Such slides usually consist of a cylindrical member approximately four inches in length and about one inch in diameter and are usually formed of a rigid material which may be either metallic, such as of steel or aluminum, or the slide may be formed of a synthetic plastic, porcelain, glass, or other suitable composition.

The guitar musician usually only employs the slide bar irregularly during playing, and as the slide is held in the hand usually fingering the individual strings on the guitar neck, the slide must be set aside and retrieved during playing. In the past, when not in use, the slide bar was deposited in a pocket, upon a nearby flat surface, such as a speaker, table, piano, or the like, and because of the cylindrical configuration of the slide, it often would roll and move from the location at which it was placed. Further, during the activity of playing, the musician may forget where he placed the slide and a perennial problem to the guitar player is remembering the slide location and being able to quickly retrieve the same when needed.

It is known in the guitar art to use holders for picks used to engage the strings wherein picks may be stored upon the guitar itself, or upon a microphone stand, as shown in U.S. Pat. Nos. 3,181,410 and 4,467,693. It is also known to provide a slide bar holder for tubular slides which may be mounted upon the guitar body as shown in U.S. Pat. No. 4,790,232. However, this latter patent does not show a slide holder which may be readily mounted by a musician of ordinary skills, and the slide bar holder is only usable with tubular slides, and requires motion of the slide in a longitudinal direction in order to mount the slide upon the holder.

Heretofore, an acceptable and versatile slide bar holder for use by guitar musicians has not been available.

OBJECTS OF THE INVENTION

It is an object of the invention to provide a guitar slide bar holder which may be readily mounted upon the guitar strap without requiring any special mechanical skills, and which will permit a guitar slide to be held in a convenient location during playing.

Another object of the invention is to provide a guitar slide bar holder which is capable of holding a variety of configurations of guitar slides and wherein the composition of the slide is not critical with respect to holder use.

A further object of the invention is to provide a guitar slide bar holder for use with ferrous slides wherein magnetic force holds the slide bar on the holder and permits the slide to be very easily manually accessible for ease of placing and removing the slide relative to the holder.

SUMMARY OF THE INVENTION

In the practice of the invention, the guitar slide holder is in the form of a U-shaped clip having parallel opposed legs each having an end attached to a bridge. The legs are spaced apart a distance as to resiliently grip a guitar strap for firm mounting thereon at the desired location.

Slide bar retention structure is mounted upon that leg disposed toward the hands of the musician. The slide retention apparatus may include clips having resilient fingers whereby the slide may be inserted between the fingers, or with a ferrous slide bar, magnets may be mounted upon the clip and by using elongated magnets spaced apart to define a cradle, a cylindrical ferrous slide may be firmly held upon the slide holder in a predetermined location and yet easily removed from, or placed thereon.

A slide bar holder in accord with the invention is economical to manufacture, attractive in appearance, and readily installed and used by the mechanically unskilled.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

A typical guitar is shown at 10 and may be either of the acoustical or electronic amplifying type. The guitar strap 12 extends between the lower end of the guitar and the lapper end of the neck in the usual manner, the strap usually being of a woven web configuration, and usually includes an adjustment buckle, not shown. The guitar 10 and strap 12 constitute no part of the present invention, but illustrate the apparatus with which the slide bar holder of the invention is used.

Figure 1:
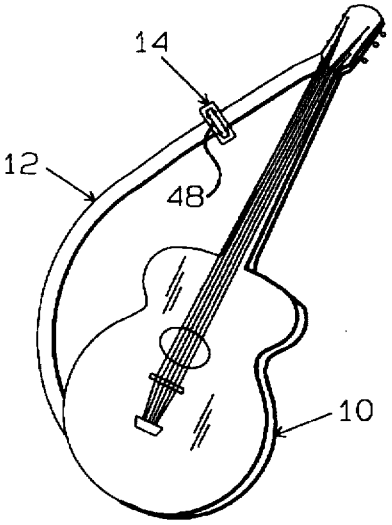
FIG. 1 is a perspective view of a guitar having a guitar strap upon which a slide bar holder in accord with the invention is mounted.

The slide bar holder 14 is mounted upon the guitar strap 12, usually in a position as will be apparent from FIG. 1 relatively close to the guitar neck. However, it will be appreciated that the slide holder 14 may be positioned on the strap 12 as desired by the musician playing the guitar 10.

The slide bar holder 14, also referred to as the slide holder, comprises a support body 16 which may be molded, or formed, of a relatively rigid material, such as of metal or molded of a synthetic plastic, and the support body is formed of a sheet type element including a first leg 18, a second leg 20 in spaced opposed relationship to the leg 18, and the legs 18 and 20 are interconnected by the bridge 22. The leg 18 includes an outer side 24, an inner side 26, a free end 28 and an attached end 30. The support body leg 20 includes an outer side 32, an inner side 34, a free end 36 and an attached end 38. The free end 36 is deformed at 40 away from the side 26 of the leg 18 to facilitate mounting of the slide holder on the strap 12. As will be appreciated from FIGS. 2 and 5, wherein the support bodies 16 and 16' are identical, the legs 18 and 20 are in parallel opposed relationship to each other as determined by the bridge 22. Even though the material of the support body 16 is relatively rigid, the natural resiliency of the material thereof, whether metal, synthetic plastic, or a composition, will permit the legs 18 and 20 to be slightly deformed away from each other, and the normal spacing between the legs 18 and 20 is such as to be slightly less than the normal thickness of the guitar strap 12.

The configuration of the legs 18 and 20 may vary from that illustrated, for instance, the leg 20 may be narrower than the leg 18, or otherwise configured, it only being necessary that the configuration of the legs 18 and 20 be such as to permit a firm gripping of the guitar strap.

Figure 2:
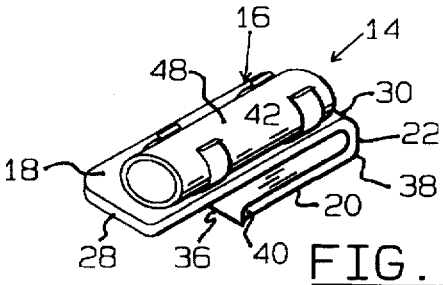
FIG. 2 is a perspective view of a slide bar holder in accord with the invention using a resilient finger clip.
Figure 3:
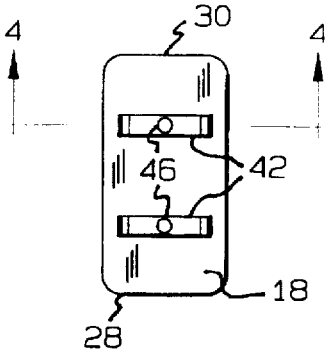
FIG. 3 is a top plan view of the slide holder of FIG. 2, the slide bar not being illustrated.
Figure 4:
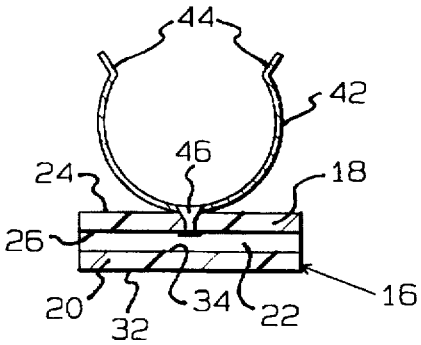
FIG. 4 is an elevational sectional view as taken along Section 4—4 of FIG. 3.

In the embodiment of the invention shown in FIGS. 2–4, a pair of finger clips 42 are mounted upon the leg 18 in the illustrated manner. The finger clips 42 are of an arcuate configuration as appreciated from FIG. 4 and include outwardly deformed ends 44 to facilitate entrance of a guitar slide into the clips. Each clip is mounted upon the leg 18 by a rivet 46, FIG. 4.

The slide or slide bar is represented at 48 and is of a cylindrical exterior configuration, is often tubular, and is formed of a rigid material such as of metal, glass, ceramic, plastic, or the like. The fingers of the clips 42 are configured and spaced apart a distance as to receive the slide bar 48 as shown in FIG. 2 and the clip ends 44 facilitate entry of the slide into the clips slightly deforming the clip fingers to resiliently grip and hold the slide within the clips and upon the support body 16. The clips 42 permit the slide bar to be readily grasped by the musician when removing the slide and the clips 42 may be used with any conventional slide regardless of the composition thereof.

The slide bar holder 14 is mounted upon the guitar strap 12 as shown in FIG. 1. The musician merely needs to slide the support body 16 upon the guitar strap 12 between the legs 18 and 20, and as the normal spacing between the legs is slightly less than the thickness of the strap, the strap will force the legs apart while the resilient nature of the bridge 46, and the resilient aspect of the legs 18 and 20 themselves, causes the legs 18 and 20 to firmly grip the guitar strap 12 and maintain the strap holder 14 thereon at the desired location. Accordingly, during use, the musician will always know the location of the slide holder 14 and may readily insert the slide 48 into the clips 42, or remove the slide therefrom as needed.

Figure 5:
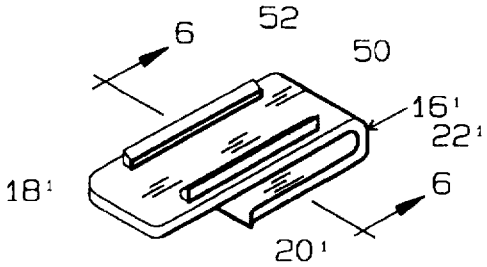
FIG 5 is a perspective view of another embodiment of a slide holder using strip magnets to define a slide cradle.
Figure 6:
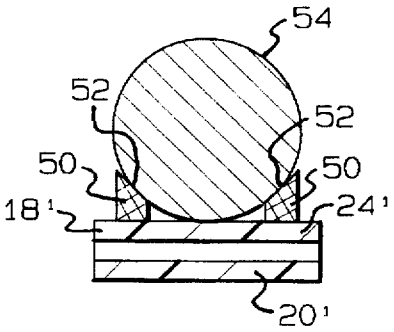
FIG. 6 is an elevational sectional view as taken along Section 6—6 of FIG. 5 illustrating a ferrous cylindrical slide mounted upon the slide holder resting upon the cradle formed by the magnets.

In FIGS. 5 and 6, an embodiment of the invention is illustrated which may be used with ferrous slides. In this embodiment, those components identical to those previously described are indicated by primed reference numerals.

Elongated strip magnets 50 are mounted upon the outer side 24' of the leg 18' by an adhesive, and the magnets 50 may be either metal or ceramic. Optimum results are produced when the support body 16' and the legs 18' and 20' are formed of a non-metallic material such as aluminum or synthetic plastic as such non-magnetic material will not affect the electromagnetic pattern of the magnets 50.

Each of the magnets 50 is provided with an outer inclined side 52 wherein the magnets 50 define a cradle for receiving the metal ferrous slide 54 as shown in FIG. 6. The magnets 50 will maintain the slide 54 on the support body 16' as shown in FIG. 6 permitting the slide to be readily placed upon, or removed from, the cradle defined by the magnets.

It is appreciated that various modifications to the inventive concepts may be apparent to those skilled in the art without departing from the spirit and scope of the invention.

We claim:

1. A guitar slide bar holder for use with a guitar having a strap characterized by ease of slide bar accessibility comprising, in combination, a support body of a U configuration having a first flat leg having outer and inner sides, a free end and an attached end, a second flat leg having outer and inner sides, a free end and an attached end, and a bridge resiliently interconnecting the attached end of said first and second legs and maintaining said legs in spaced relation, and releasable slide bar holding means defined upon said first leg outer side adapted to solely exteriorly contact a slide bar for selectively retaining a slide bar thereon whereby upon inserting the guitar strap between said inner sides of said legs said legs resiliently grip the strap conveniently positioning said support body and slide bar holding means relative to the guitar.

2. In a guitar slide bar holder as in claim 1, said bridge and first and second legs being formed of a homogeneous body of material.

3. In a guitar slide bar holder as in claim 2, said support body being formed of a synthetic plastic material.

4. In a guitar slide bar holder as in claim 2, said support body being formed of a metallic material.

5. In a guitar slide bar holder as in claim 1, the length of said first leg from said free end to said attached end thereof being greater than the length of said second leg.

6. In a guitar slide bar holder as in claim 5, said second leg free end being deformed away from said first leg inner side.

7. A guitar slide bar holder for use with a guitar having a strap characterized by ease of slide bar accessibility comprising, in combination, a support body of a U configuration having a first flat leg having outer and inner sides, a free end and an attached end, a second flat leg having outer and inner sides, a free end and an attached end, and a bridge resiliently interconnecting the attached end of said first and second legs and maintaining said legs in spaced relation, and releasable slide bar holding means defined upon said first leg outer side adapted to solely exteriorly contact a slide bar for selectively retaining a slide bar thereon whereby upon inserting the guitar strap between said inner sides of said legs said legs resiliently grip the strap conveniently positioning said support body and slide bar holding means relative to the guitar, said releasable slide bar holding means comprising resilient clips extending from first leg outer side.

8. A guitar slide bar holder for use with a guitar having a strap characterized by ease of slide bar accessibility comprising, in combination, a support body of a U configuration having a first flat leg having outer and inner sides, a free end and an attached end, a second flat leg having outer and inner sides, a free end and an attached end, and a bridge resiliently interconnecting the attached end of said first and second legs and maintaining said legs in spaced relation, and releasable slide bar holding means defined upon said first leg outer side adapted to solely exteriorly contact a slide bar for selectively retaining a slide bar thereon whereby upon inserting the guitar strap between said inner sides of said legs said legs resiliently grip the strap conveniently positioning said support body and slide bar holding means relative to the guitar, said releasable slide bar holding means comprising magnet means mounted on said first leg outer side.

9. In a guitar slide bar holder as in claim 8, said magnet means comprising a pair of elongated spaced magnets defining a cradle for receiving a slide bar.

* * * * *